United States Patent [19]

Fagnoni

[11] Patent Number: 4,726,158

[45] Date of Patent: Feb. 23, 1988

[54] TRANSPORTABLE STRUCTURE, TO BUILD HOUSES OR OTHER DWELLINGS

[75] Inventor: Giovanna M. Fagnoni, Florence, Italy

[73] Assignee: Edil.Pro S.p.A., Italy

[21] Appl. No.: 865,162

[22] Filed: May 19, 1986

[30] Foreign Application Priority Data

May 21, 1985 [IT] Italy ..... 9415 A/85

[51] Int. Cl.[4] ..... E04B 1/343

[52] U.S. Cl. ..... 52/79.5; 52/68; 52/143

[58] Field of Search ..... 52/79.5, 143, 64–71

[56] References Cited

U.S. PATENT DOCUMENTS

| | | | |
|---|---|---|---|
| 2,395,691 | 2/1946 | Smith | 52/69 |
| 3,284,966 | 11/1966 | Bolt | 52/79.5 X |
| 3,348,344 | 10/1967 | Tatevossian | 52/79.5 X |
| 3,633,324 | 1/1972 | Cuylits | 52/66 |
| 3,800,484 | 4/1974 | Marshall | 52/69 |
| 3,971,185 | 7/1976 | Hendrich | 52/79.5 X |
| 4,534,141 | 8/1985 | Fagnoni | 52/68 |

FOREIGN PATENT DOCUMENTS

| | | | |
|---|---|---|---|
| 653362 | 3/1979 | U.S.S.R. | 52/79.5 |

*Primary Examiner*—J. Karl Bell

*Attorney, Agent, or Firm*—McGlew and Tuttle

[57] ABSTRACT

A transportable structure to form houses and the like, for immediate use in case of calamities and for other uses, comprises a supporting framework made up of closed longitudinal frames, floor platform, roof covering and head walls, all of which delimiting a useful volume, and mobile panels that are able to form additional side rooms. The mobile panels are finished with protruding elements, which form, at least in part, cylindrical surfaces slidingly cooperating to form articulations. Angle bars are provided at the ends of the structural sections to make up the seats for pins that are able to prevent the cooperating cylindrical surfaces from incidentally moving away from each other. Further angle bars perimetrically complete the panels while seals mounted on the sections coact with the sections being coupled at the articulations to ensure sealing.

12 Claims, 47 Drawing Figures f 27

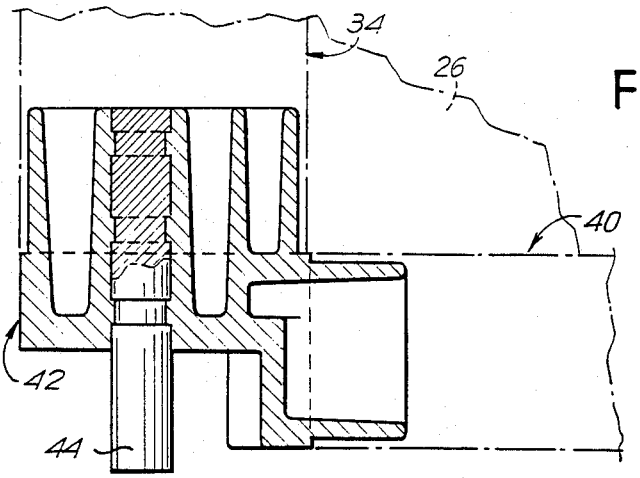
Fig.7
Fig.8
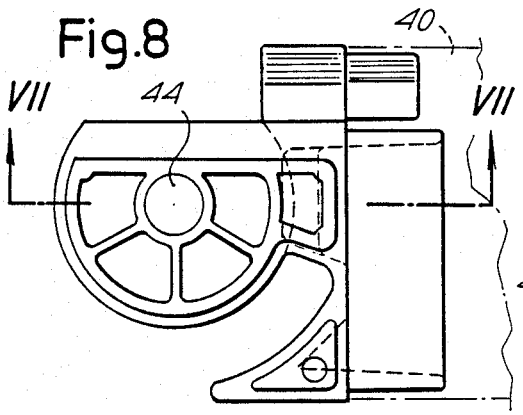
Fig.9
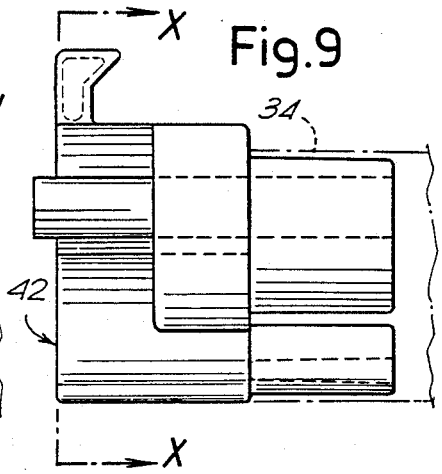
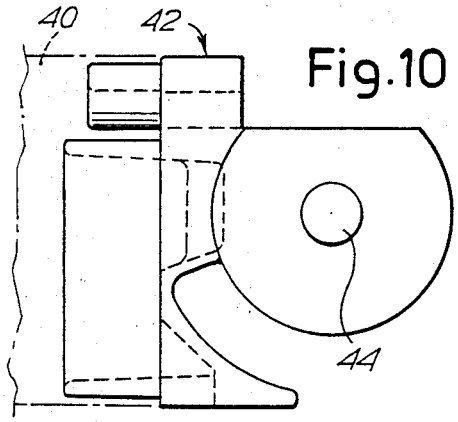
Fig.10
Fig.11
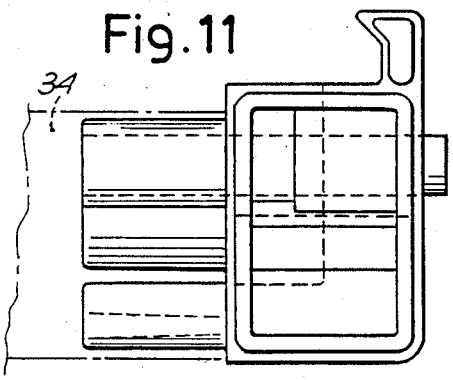

Fig. 21
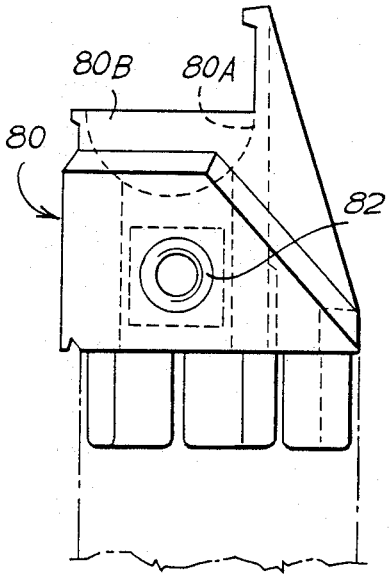
Fig. 23
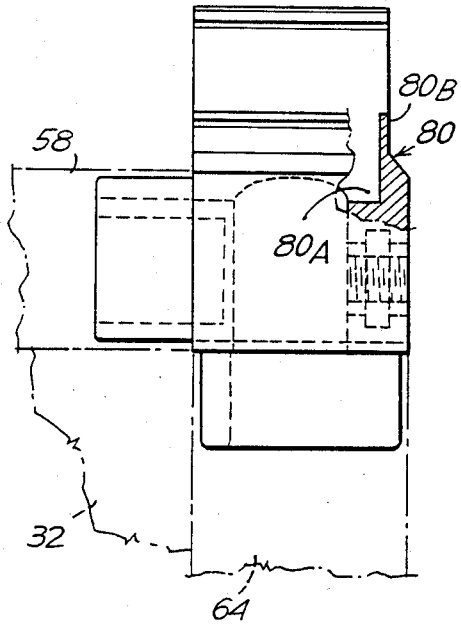
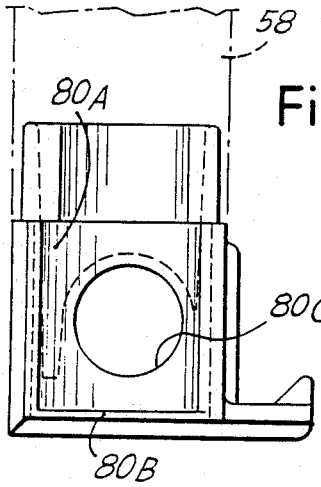
Fig. 22

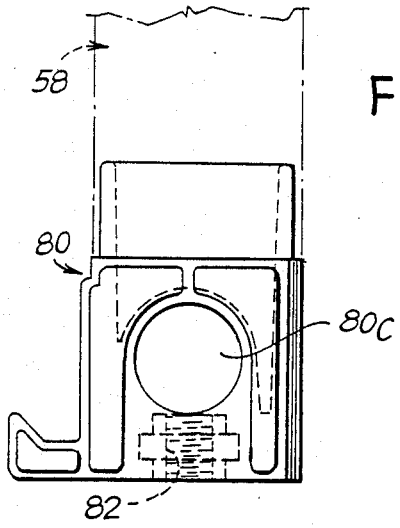
Fig. 24
Fig. 25
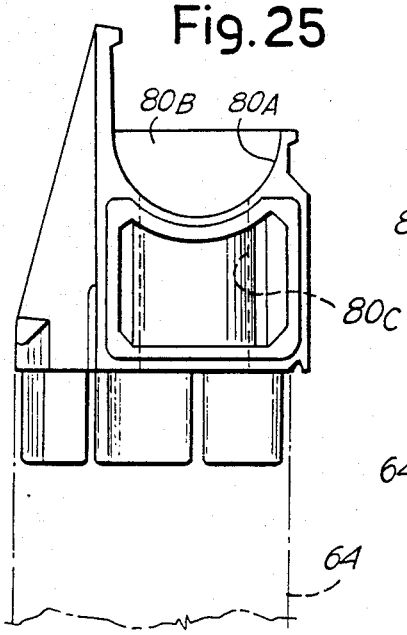
Fig. 26
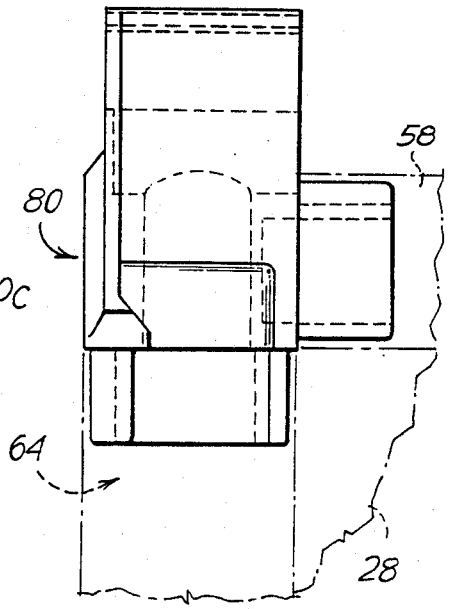

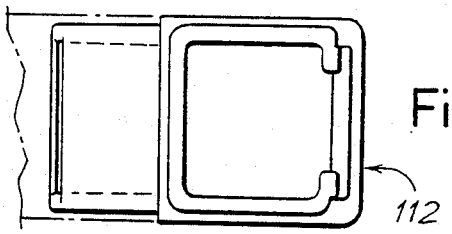
Fig.30
Fig.28
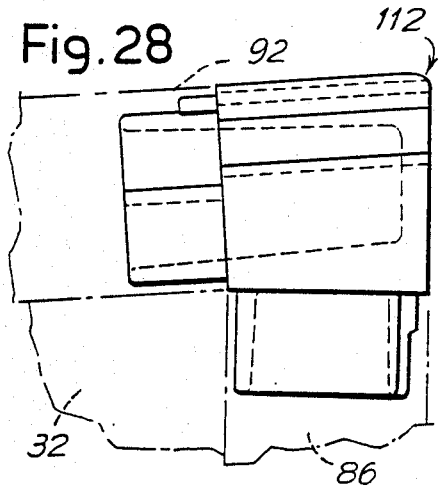
Fig.29
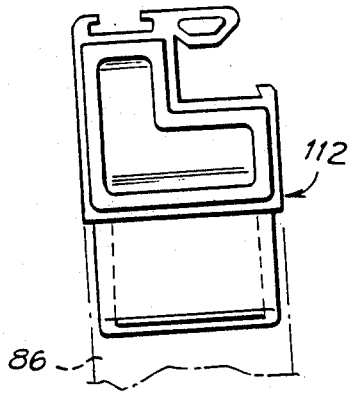
Fig.32
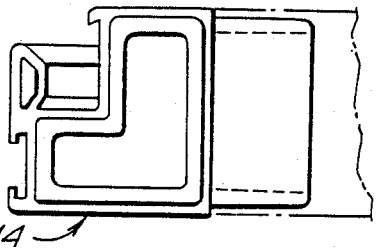
Fig.33
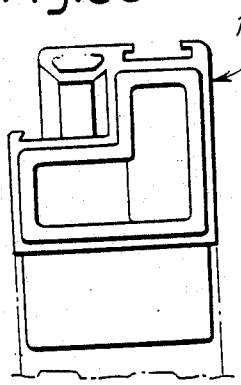
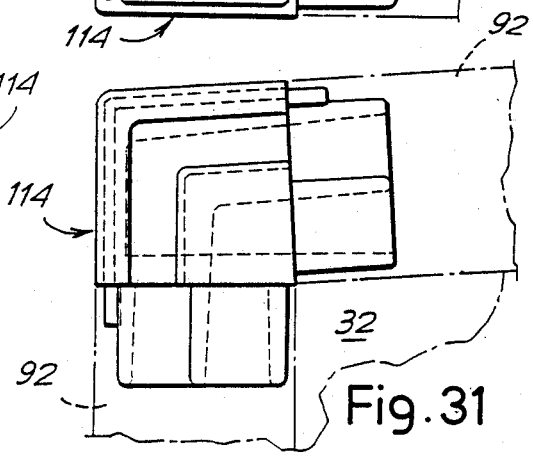
Fig.31

TRANSPORTABLE STRUCTURE, TO BUILD HOUSES OR OTHER DWELLINGS

FIELD AND BACKGROUND OF THE INVENTION

The present invention relates in general to collapsible structures which can form houses or the like.

SUMMARY OF THE INVENTION

The invention has the object of providing an improvement to a transportable structure to build houses and the like, for immediate intervention in case of calamities and for other uses, comprising a supporting framework made up of closed longitudinal frames, a floor plane or platform, a roof covering and head walls, all of which delimit a useful volume, an overturnable paneling, forming the roof covering, being articulated below the roof covering, an overturnable paneling, forming the floor, being articulated to the floor plane of the framework, and an overturnable paneling forming a vertical longitudinal wall being articulated to the floor-forming paneling on the side opposite to the articulation of the latter to the supporting framework. During transportation and storage, the floor paneling is external and the covering paneling is internal. During use, the floor-forming panelings of the additional side volumes rest on legs articulated below the supporting framework to be spaced apart and provided with bearings that are adjustable on the ground.

According to the invention, the mobile panelings are finished with protruding elements or protrusions or which make up at least part of cylindrical surfaces slidingly cooperating to form articulations. Angle bars are provided at the ends of these structural sections to form the seats for pins that are able to prevent the cooperating cylindrical surfaces from incidentally moving away from each other. Further angle bars perimetrically complete the panels. Seals mounted on the sections coact with the sections being coupled at the articulations, to ensure sealing.

Longitudinal articulations between the fixed platform and the mobile platforms may exhibit, in one of the sections, an arcuated appendix and, in the other section, an arcuated seat for said arcuated appendix.

One of the sections of the longitudinal articulation between the mobile platform and the longitudinal wall may present a surface with a hook stop able to cooperate with a corresponding surface of the section of the longitudinal wall.

A seal may be provided along each longitudinal edge of the covering, in order to cooperate with the respective mobile covering in the opening condition, and with the external section of the mobile platform in the closing condition.

Suitable seals may be arranged inwardly of the head walls to cooperate, in the opening condition, with the plugging or curtain walls and, in the closing condition, with the side sections of the mobile platform.

The mobile covering may be articulated and made to rest through a section provided with an appendix, slidingly supported—for angular movement—on a cradle carried by the fixed covering, and a shaped flashing is capable of coacting with a mobile element which is supported to complete the ceiling in the opened condition, and is lifted in the closed condition.

The invention will be better understood by following the description and the accompanying drawing which shows a practical non limitative exemplification of the same invention. In the drawings:

BRIEF DESCRIPTION OF THE DRAWINGS

FIGS. 7 to 11 show in various views an internal angle bar between the sections of the mobile platform;

FIGS. 21 to 26 show, in various views, an upper angle bar of the longitudinal wall;

FIGS. 28 to 30 show an upper angle bar for correspondence with the hinge of a mobile curtain wall articulated to a head wall;

FIGS. 31, 32 and 33 show an upper angle-bar opposite to that of FIGS. 28 to 30, on the inclined upper side of a curtain wall;

DESCRIPTION OF THE PREFERRED EMBODIMENT

Figure 1:
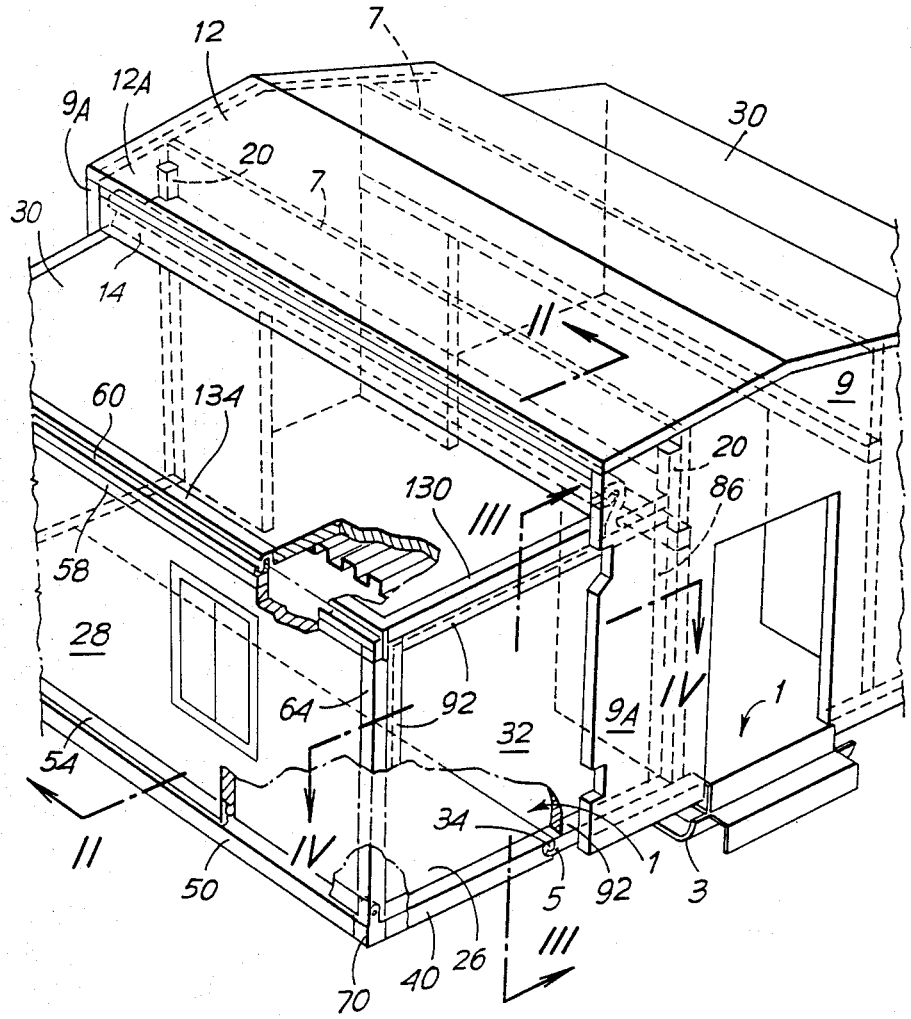
FIG. 1 shows an ensemble perspective view of the invention in the use or opened condition.

In the drawing (FIG. 2), numeral 1 indicates the fixed platform or fixed floor, which is mounted on longitudinal beams 3 (FIG. 1) that are skid or shoe-shaped at their bottoms in order to make the structure, resting on the ground, slidable over the ground for its laying at a site. Along the longitudinal edges of the fixed platform 1, two symmetrical sections 5 of extruded light alloy are applied, each of which making up a lower curved cradle for the support and rotation of protruding section or protrusion 34 that are made up of glass fiber reinforced polyester. Numerals 7 and 7A (FIGS. 1, 2 and 6) indicate longitudinal structures which connect two head walls 9 of the rigid assembly. In particular, the structures 7 are joined to the roof or fixed covering 12. The covering 12 projects beyond the structures 7 at its part 12A, similarly to the longitudinal edges of the fixed platform provided with sections 5. At the end of each one of the parts 12A of the fixed covering, a skirt section 14 is provided for an upper longitudinal edging, which section 14 forms a protrusion as well. Section 14 is applied to a metal section 16 that is solid with the part 12A of the fixed covering. An upper cradle section 18 is connected to metal section 16 for the support and rotation of a corresponding mobile covering 30.

The head walls 9 extend through lateral parts 9A (see FIGS. 4 and 5) provided with vertical columns 20 making part of the central structure. These columns 20 carry vertical hinges 22 connected thereto for the mobile curtain walls 32.

On each side of the central rigid structure, a set of mobile panels are provided (FIG. 1) listed as follows a mobile side floor 26, which is articulated to the cradle 5; a longitudinal wall 28, which is articulated to the outer end of the mobile floor 26 to be supported thereby; a mobile covering 30 which is articulated to the cradle section 18; and curtain walls 32, which are articulated to the two vertical hinges 22 of the two head walls 9.

Figure 2C:
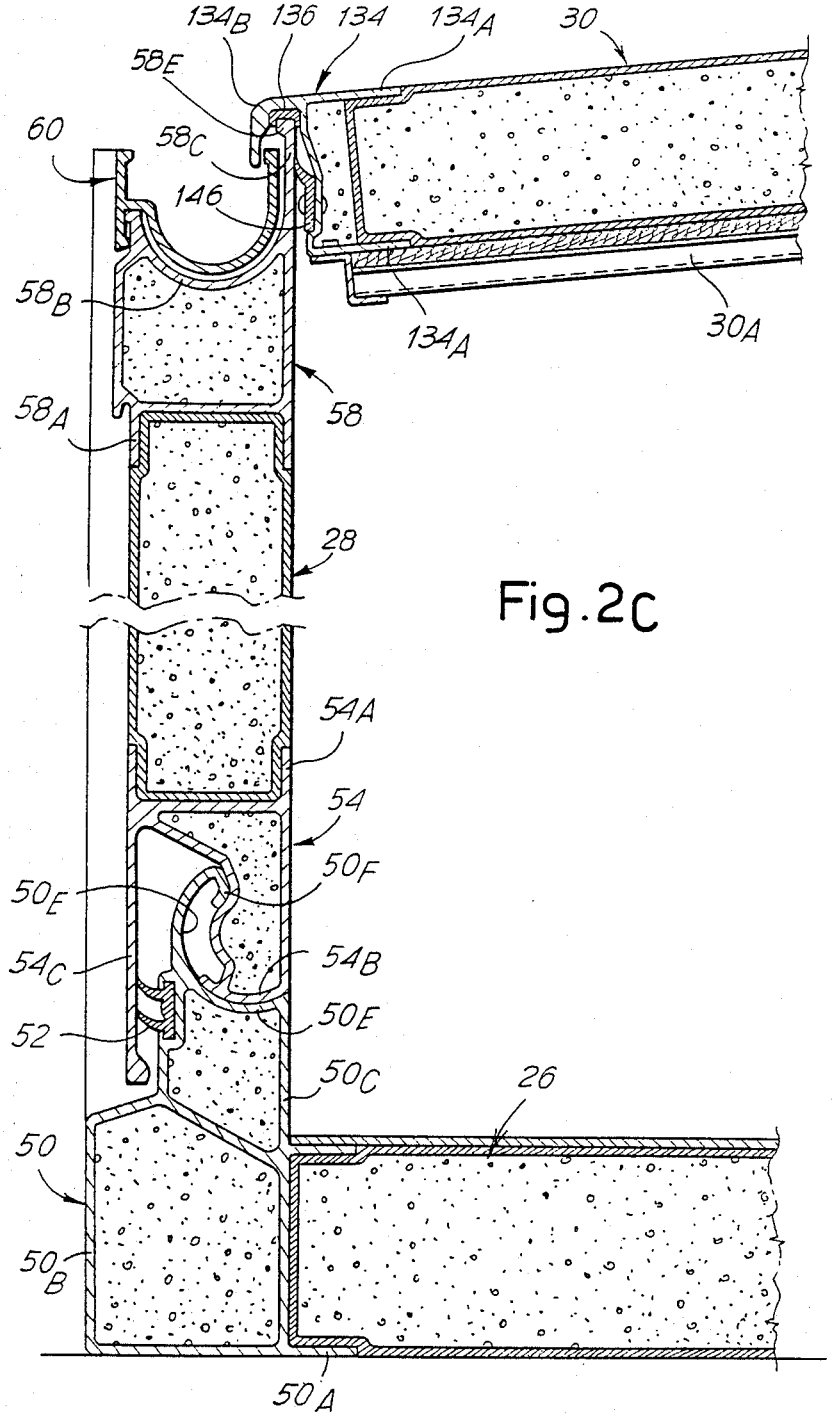
Figure 3:
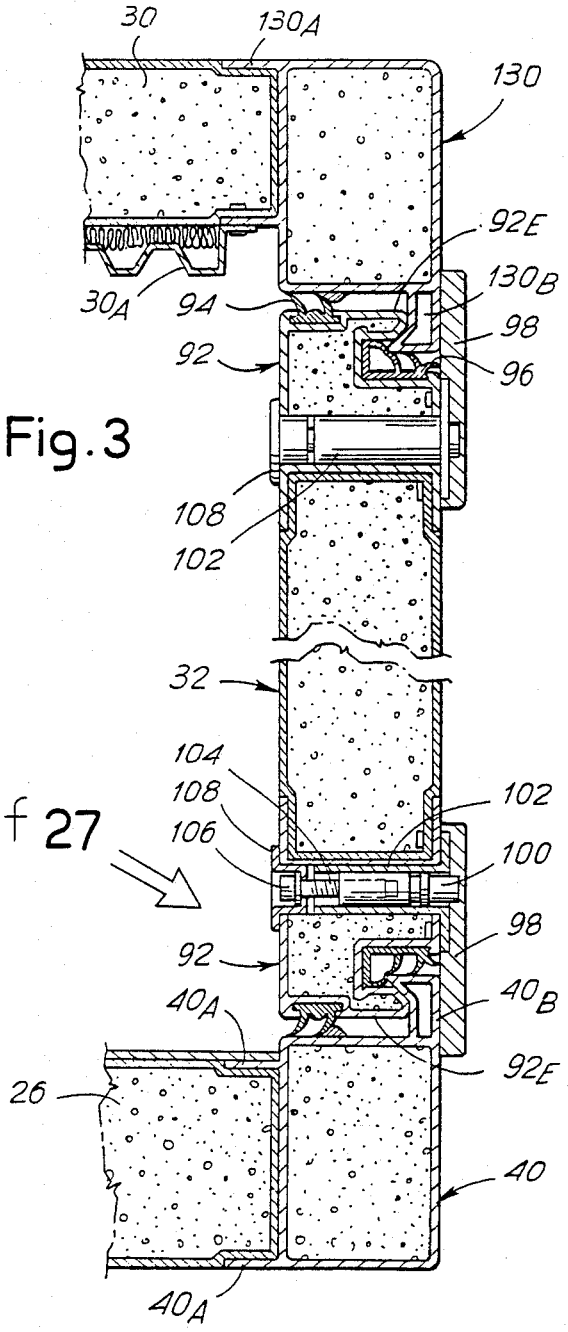
FIG. 3 shows a sectional view on line III—III of FIG. 1, that is, according to a vertical plane perpendicular to the panel that forms a curtain wall.
Figure 12:
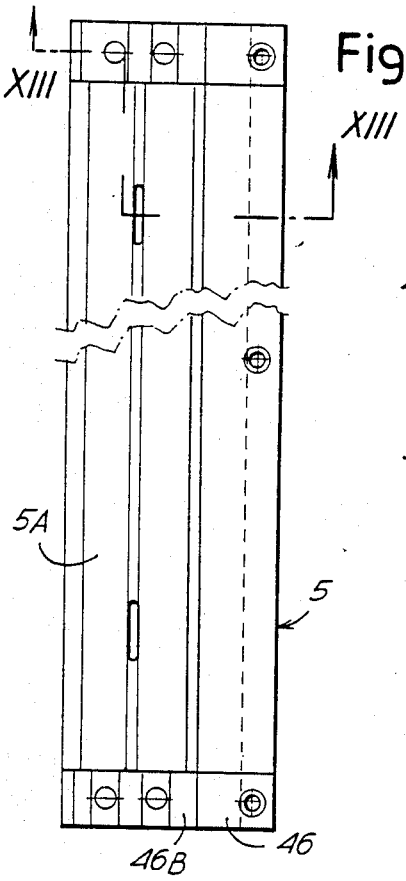
FIGS. 12 and 13 respectively show a detail of a cradle-shaped section for the articulation of the mobile platform to the fixed platform, and an enlarged sectional view on line XIII—XIII of FIG. 12.
Figure 13:
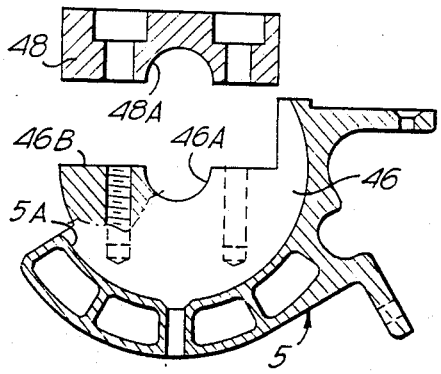

The mobile platform 26 (see FIG. 2C) is provided with a protrusion section 34 which is capable of cooperating with the cradle section 5 on which it is made to rest. The hinge between the fixed platform 1 and the mobile platform 26, made up of the section 5 and section 34, is developed as a cradle profile 5A formed by the extruded light-alloy piece 5 and by a cylindrical downwardly convex protrusion 34A formed by the protrusion section 34, which has also a curved notch 34B shaped to partially receive the upwardly concave cradle profile 5A of the light alloy extruded section 5. In this way, when the mobile platform 26 is lowered into alignment with the fixed platform 1, an effective sealing is achieved inside the interstice between the two platforms. This sealing extends to length of floors 1 and 26. The mobile floor or platform 26 is defined (see FIG. 3) by the section 34 at the inside end and by two side sections 40 each of which has wings 40A for the fastening of said mobile platform to the panel and an appendix 40B forming a profile shaped as an inclined plane, for coupling with the corresponding section of the curtain wall 32. Between the sections 34 and 40, an angle bar 42 is provided, being better illustrated in FIGS. 7 to 11 which show it in various views. The angle bar distinctively exhibits a pin 44 intended to provide a constraint against the relative removal between the two sliding cylindrical surfaces 5A and 34A, while the supporting pressures of the mobile platform resting on the fixed platform are assured by the contact between the two sliding cylindrical surfaces of the sections 5 and 34. To engage the pin 44, on each end of the section 5 of each one of the longitudinal edges of the fixed platform 1, a terminal 46 (FIGS. 12, 13) is provided, having a semicylindrical seat 46A in correspondence of a right-angle housing 46B to which a block 48 may be fixed, this block being provided as well with a semi-cylindrical seat 48A so as to make up—together with the seat 46A—a seat for the engagement of the pin 44. The block 48 is applied, after the mobile platform has been arranged in the cradle profile 5A of the section 5, in such a way that the mobile platform 34 is retained by the pin 44 engaged by the block 48 within the seat formed by the two semicylindrical seats 46A and 48A. In this way, the constraint between the mobile platform 26 (and in particular its section 34) and the longitudinal edges of the fixed platform 1 is made stable.

For the engagement of the section 5 to the fixed platform 1, the latter is provided with a laminar shaped section 1A on which the section 5 is applied through a pair of flanges 5E, 5F of the same section 5, which are inclined to each other for their coupling with the laminar section 1A being steadily engaged to the fixed platform 1.

The section 34 is provided with flanges 34C for coupling to the mobile platform 26, with a disposition similar to that of flanges 40A of the section 40 of the same mobile platform 26.

The mobile platform 26 is delimited by the section 34 for the coupling to the fixed platform 1, by the two side sections 40 for the coupling to the curtain walls 32, and also by an external section 50 which is coupled, by means of flanges 50A, to the same panel 26. The section 50 (see FIG. 2C) has a box-like structure with an end surface 50B and an extension 50C, which makes up a semicylindrical saddle 50E with an arcuate stop terminal 50F, and forms as well a seat for a seal 52. The saddle 50E is intended to slidingly couple the longitudinal mobile wall 28 to the mobile platform 26. This longitudinal mobile wall 28 has, on the edge, being in the use arrangement in a lower position, a section 54 with flanges 54A for the engagement to the same panel 28 and with a cylindrical, partially convex profile 54B able to slide on the surface of the semicylindrical saddle 50E of section 50 of the mobile platform 26. The section 54 forms also a wing 54C which represents the extension of the outer surface of the longitudinal mobile wall 28. The wing 54C is able to cooperate with the seal 52 when using the assembly as a house, in the manner clearly visible in FIG. 2.

The panel of the mobile longitudinal wall 28 is finished, at the edge opposite to that of the section 54, by means of a section 58 with flanges 58A for its engagement to the panel 28 of the longitudinal wall and with a longitudinal channel 58B flanked by a wall 58C provided with a terminal heel 58E. Within the channel 58B a gutter 60 may be received, easily removable from the channel 58B and retained between the sides of this channel and the heel 58E.

The sections 54 can engage at 50, 50F the sections of the mobile platforms.

The longitudinal wall 28 is delimited by the horizontal sections 54 and 58, and by two sections 64 (FIG. 4) which extend vertically in the use or opened arrangement, and are provided with flanges 64A for coupled to the panel 28. Both sections 64 have a deep channel 64C which extent vertically in the use condition. Within said channel 64C a down pipe 66—being provided with a diverted exhaust mouth 66A—is housed. Advantageously, the channel 64C is opened laterally rather than on the outer front of the longitudinal external mobile wall 28. The down pipe 66 is joined to the gutter 60 that is housed in the section 58 of the same mobile wall 28.

Figure 14:
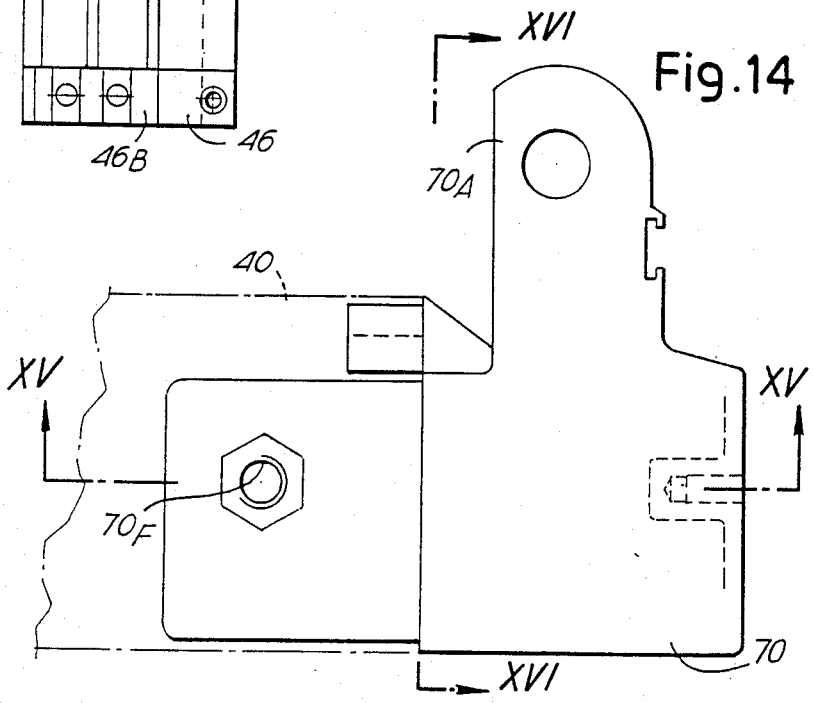
FIGS. 14, 15, 16, and 17 show, in various plan and sectional views, an external angle bar between the sections of the mobile platform, with a seat for a pin providing a constraint between the mobile platform and the mobile longitudinal wall.
Figures 15, 16, 17:
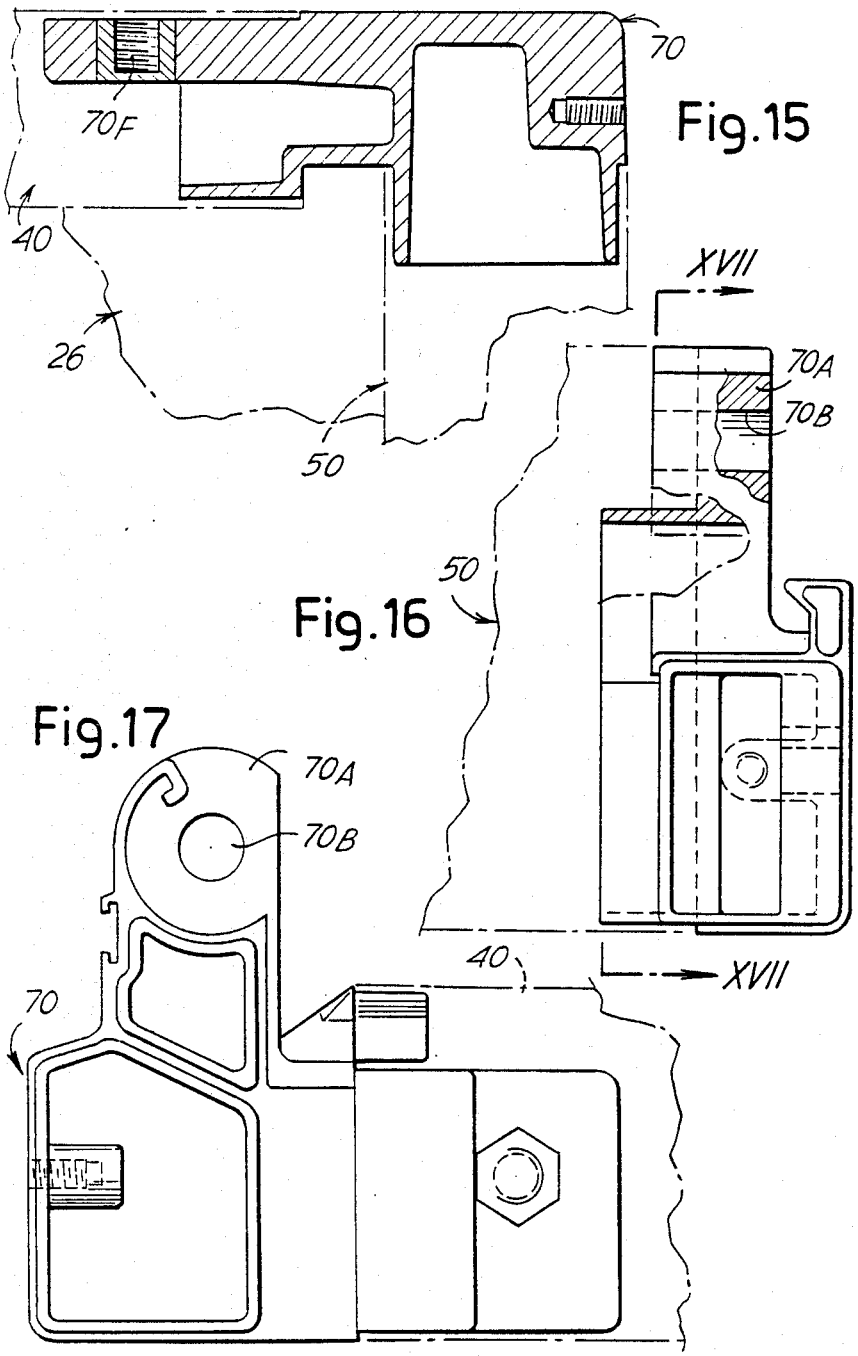

FIGS. 14 and 17 show an angle bar 70 that is intended to complete the external angle of the mobile floor 26, that is, the connection between the two sections 40 and 50 concurrent to said angle bar 70. In particular, said angle bar has an appendix 70A making up a retaining side of the section 50. The appendix has a hole 70B which is intended to receive an engagement pin for preventing the relative removal between the two sections 50 and 54 and thus between the mobile platform 26 and the longitudinal wall 28 which, however, rotate on the surface 50E and on the corresponding surface 54B of the section 54.

Figure 20:
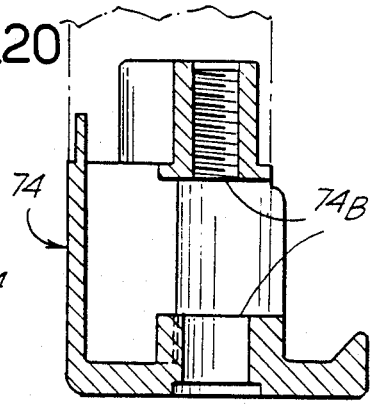
FIGS. 18, 19, and 20 show in two views and in a sectional view on line XX—XX of FIG. 19, a lower angle bar of the longitudinal wall.
Figure 19:
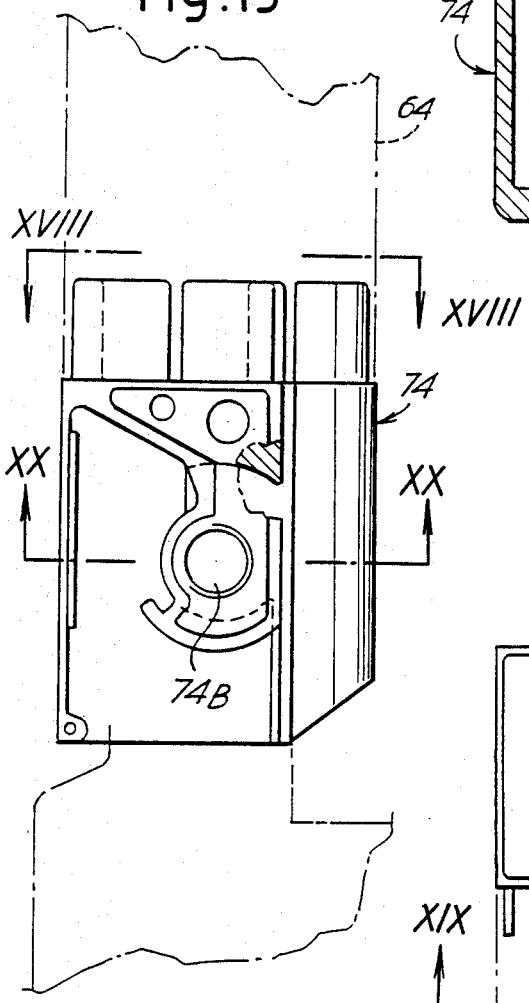
Figure 18:
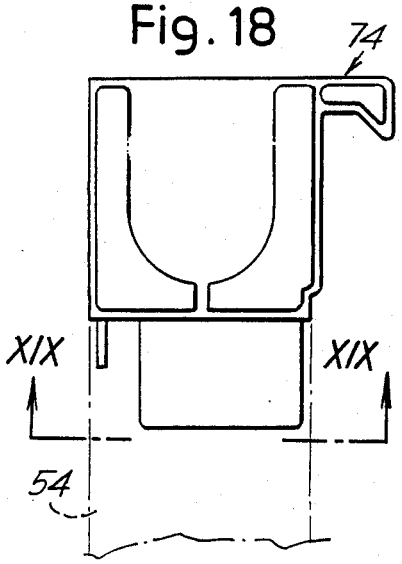

FIGS. 18, 19 and 20 show an angle bar 74,—that is the lower angle bar of the longitudinal wall 28—which angle bar 74 is applied to the end of section 54 for cooperating with the angle bar 70 (FIGS. 15 to 17) provided at the end of the section 50 of the mobile platform 26. This angle bar 74 has, in particular, a hole 74B intended to receive a pin which can be inserted, from the outside, either into the hole 74B or into the hole 70B of the angle bar 70, at each end of the mobile channel respectively of the longitudinal mobile wall 28, for engaging these two panels against a relative removal between the slidingly coupled surfaces 54B and 50E. The pressure stress between the two panels is discharged along the sliding surfaces 54B and 50E exhibiting a cylindrical profile. The angle bar 70 further comprises a seat for a hole 70F provided for the hooking of the metal rope necessary to carry out the operation for rotating the whole panel.

FIGS. 21 to 26 show in various views an angle bar 80 which is developed through a cavity 80A, a wall 80B and a hole 80C, and which has the purpose of connecting the sections 58 and 64 of the longitudinal mobile wall 28 between them. The gutter 60 is housed inside the section 58 of the longitudinal wall 28. An angle bar 170 (FIGS. 40 to 44), included in the angle bar 80, has a joint 170A intended to receive the end of the gutter 60. The angle bar 170—being closed at its end by a wall 170B—provides a terminal bank for said gutter. To the cavity 170D, a pipe 170C is joined, which pipe enters the hole 80C and is provided for the fitting of the down pipe 66. In correspondence with the hole 80C, a bush 82 is embedded for the screwing of a pin intended to hook the rope by which the rotation for moving the panel 28 from the horizontal position above 26 to the vertical position, is carried out.

Figure 27:
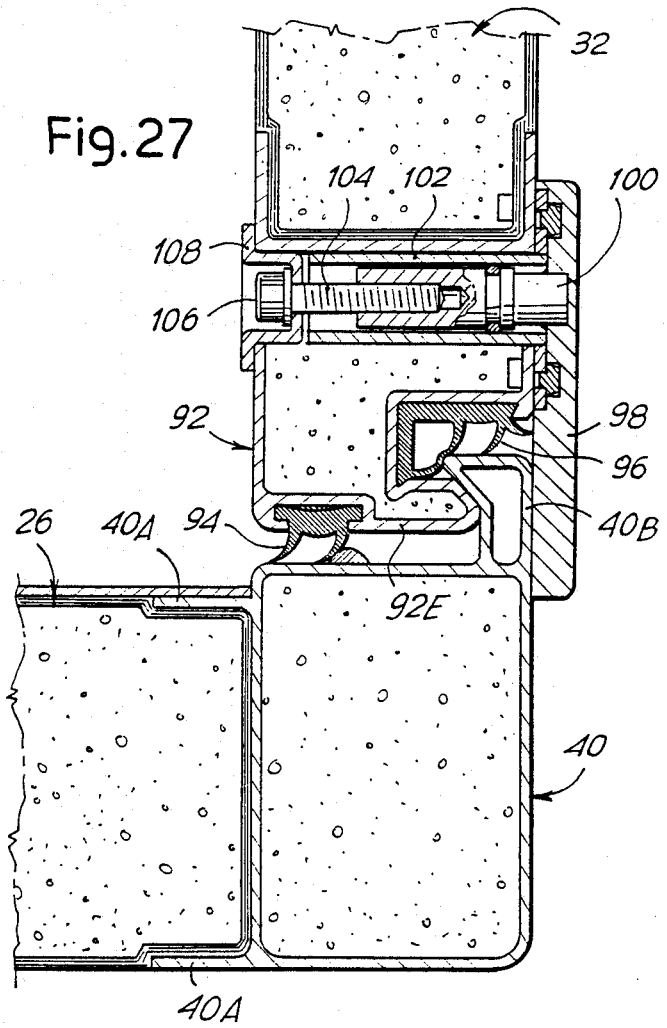
FIG. 27 shows a detail of a section surrounding the curtain wall, with latch clamping means, as an enlargement of the portion indicated by f27 in FIG. 3.

Each of the curtain walls 32 is delimited, along the vertical articulation hinge 22, by a section 86 provided with flanges 86A for its coupling to the panel 32 and with plates 88 embedded therein for the engagement of wings 90 which make up the hinge member cooperating with the members 22 fastened to the corresponding section 20. On the other three sides, each of the panels 32 of the curtain wall is completed by segments of a section (protrustion) 92, which comprises two flanges 92A for the engagement with the panel, a seat 92B for a seal 94 and a right-angle seat 92C for a seal 96. Moreover, the section 92 has an appendix 92E shaped as an inclined plane. At spaced points, each of the protrusion 92 which form the three—upper, lower and outer—sides of panel 32 of the curtain wall, has a seat for a latch means. FIG. 27 shows a detail of this latch means. The comprises an outer lever plate 98 which is welded to a shank 100 rotatively housed in a sleeve 102 inserted into the protrusion 92. The shank 100 is axially engaged by a screw stem 140, whose head 106 can be reached from the inside of the dwelling and is received within a dished washer 108 located in a corresponding hole of the section 92. The arrangement is such that the lever 98 may be moved from a position lined up with the section 92 to a position more or less orthogonal therewith, wherein said projecting lever 98 comes in contact with the section 40 of the mobile platform 26 and with the vertical sections 64 of the outer longitudinal wall 28, and further with the side protrusions of the mobile covering 30 to be described below. Under these conditions, the lever 98 may be recalled i.e. returned through the screw means 104, 106, thereby forcing the appendixes one towards the other, for instance forcing the appendix 40B or 64B of sections 40 and 64 against the inclined plane appendix 92E of the corresponding section 92, in order to force the concurrent panels one against the other according to an inclined plane, for a wedging action. A similar disposition is provided for the forcing action by the side sections of the mobile covering 30.

FIGS. 28 and 30 show an angle bar 113 which is provided for joining the vertical protrusion 86 and the upper and inclined protrusion 92 of a curtain wall 32. FIGS. 31 to 33 show an angle bar 114 disposed at the opposite side in respect to the angle bar 112 on the upper inclined side of a curtain wall. These angle bars 112, 114 exhibit profiles similar to those indicated by 92B and 92C for receiving, without solution of continuity, the two seals 94 and 96 up to the end of the panel. These two angle bars are developed with an angle other than 90° and, in particular, smaller than 90° for the angle bar 112 and greater than 90° for the angle bar 114. Analogous angle bars located in the lower positions, that is, at the ends of the lower side of the curtain wall, are similar to those indicated by 112 and 114, but with an amplitude of exactly 90°; since the angles formed by the curtain panels in the lower part are actually right angles.

Figure 2:
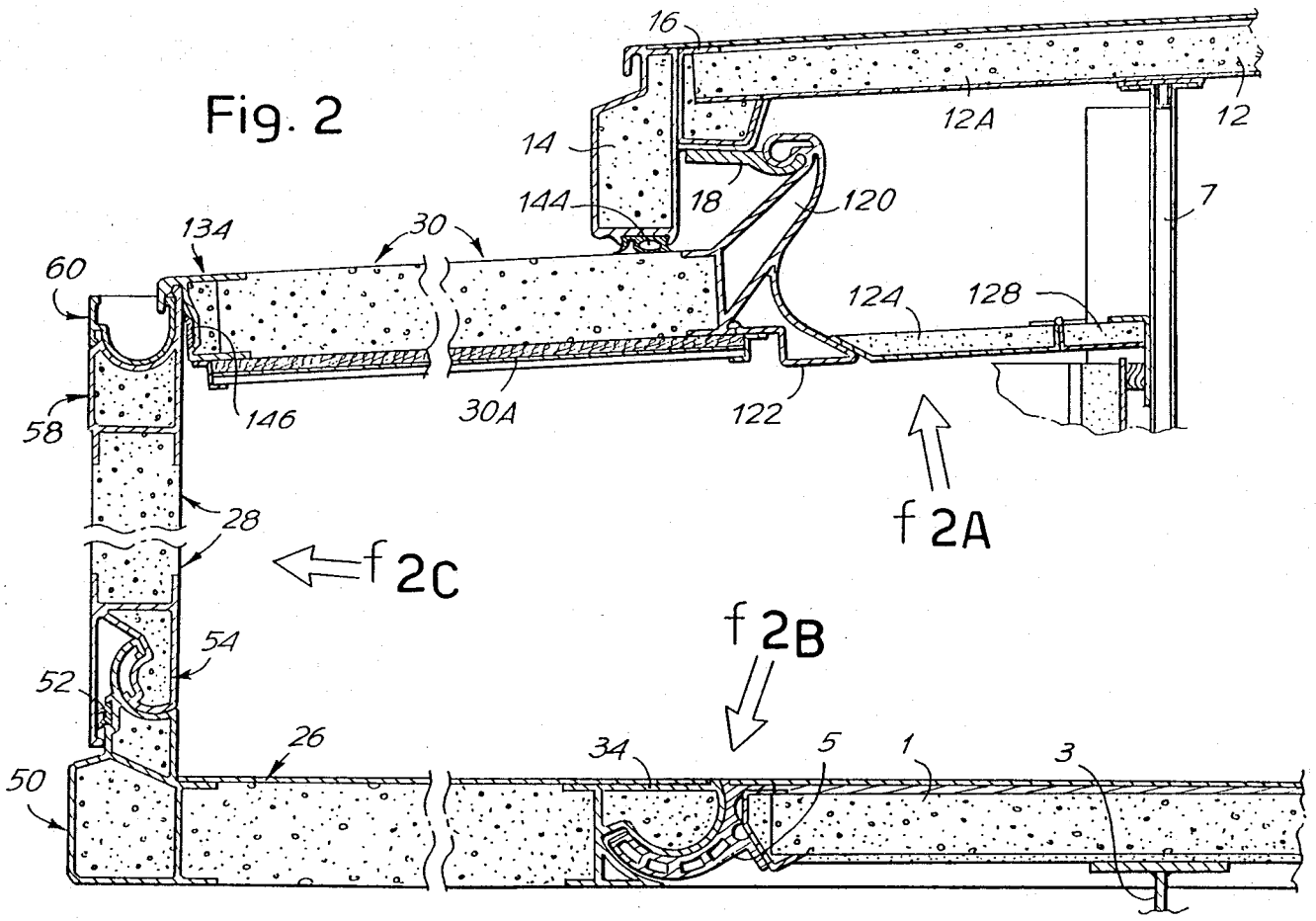
FIGS. 2, 2A, 2B, and 2C respectively show a vertical sectional view on line II—II of FIG. 1, that is, according to a plane perpendicular to the longitudinal wall, and three enlarged details indicated by arrows f2A, f2B and f2C in FIG. 2.
Figure 2A:
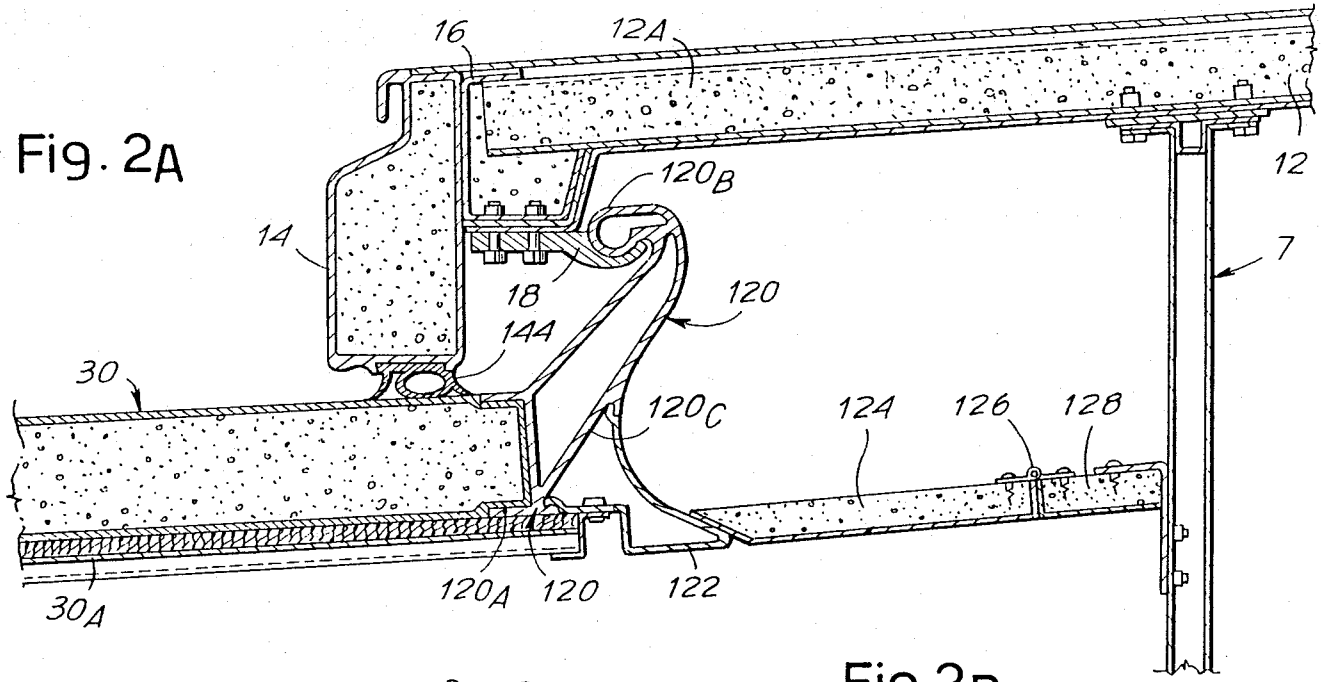
Figure 6:
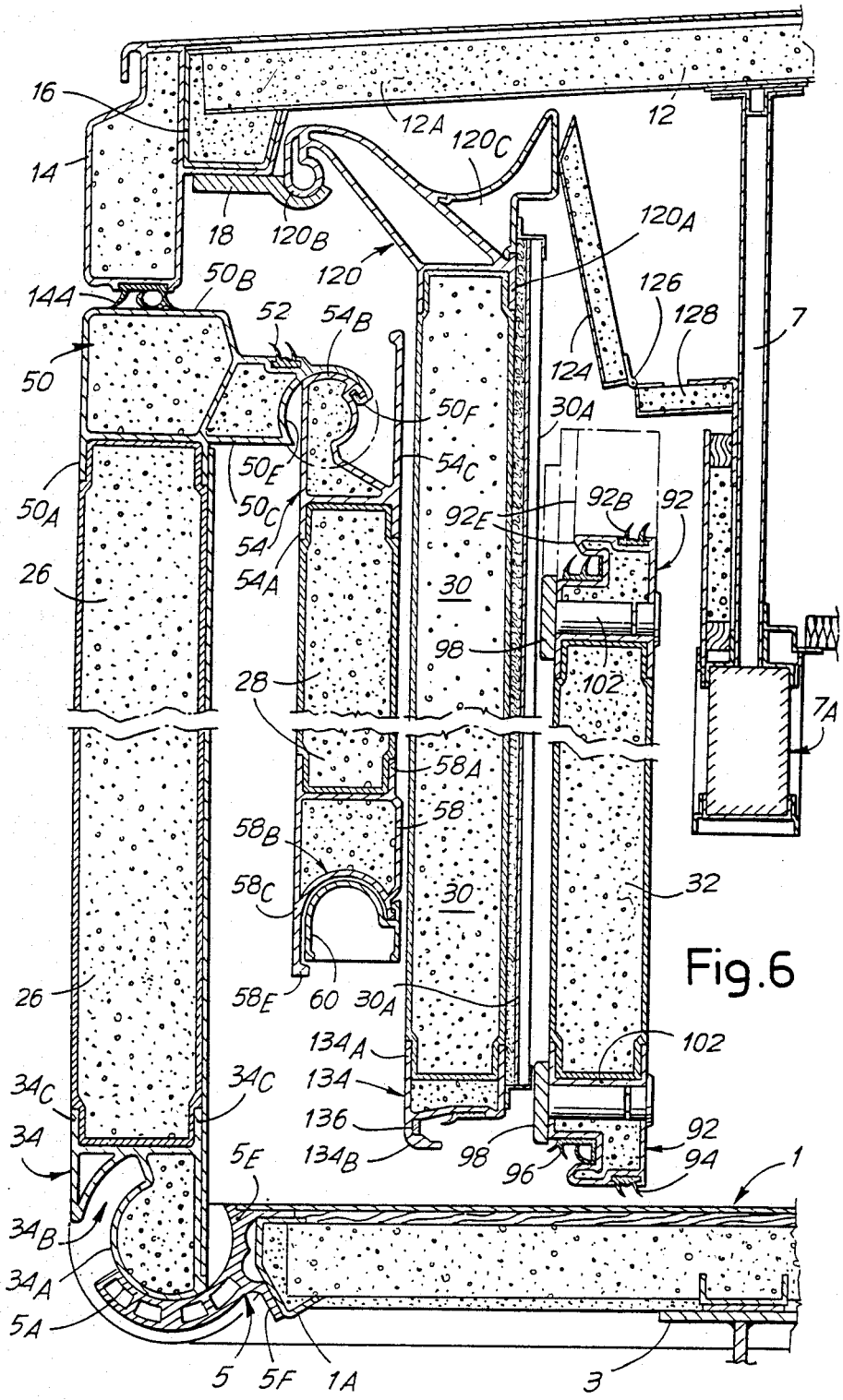
FIG. 6 shows a sectional view similar to that of FIG. 2 but with the components in the closed condition.

Each of the covering panels 30 has, along the inner edge and articulated to the extension 12A of the fixed covering 12, a finishing section 120 exhibiting flanges 120A for the coupling to the panel 30 and an inclined shaping to end with an articulation nucleus 120B for resting on the cradle bracket 18 fixed to the already described section 16 of the extension 12A. The nucleus 120B can slide within the cradle to allow the angular displacement of the mobile covering panel 30 between the use position, being slightly downwardly and outwardly inclined, and the greatly downwardly inclined position resulting close to the main structure (FIGS. 2 and 6). The section 120 has also a seat 120C which is of use to receive an elastic flashing 122 shaped as shown in the drawing, to complete the ceiling. The ceiling is defined—in the use position—by a thickness 30A below the covering panel 30, by the flashing 122 and by a mobile element 124, which is articulated at 126 to a profile 128 being secured to the wall 7 of the fixed main structure. In the use arrangement (FIG. 2), the parts 124, 122 and 30A make up a substantially continuous surface. Upon shifting from this arrangement to the arrangement of least overall-dimensions shown in FIG. 6 by the rotation of the nucleus 120B on cradle 18, the flashing 122 pushes the element 124 upwards by means of its cusp, thus causing it to rotate around the hinge 128 until the same element 124 takes up the position shown in FIG. 6. The reversed movement causes the flashing 122 to perform an opposite action thereby allowing the lowering of the element 124 until it rests on said flashing in the condition shown in FIG. 2.

Figure 2B:
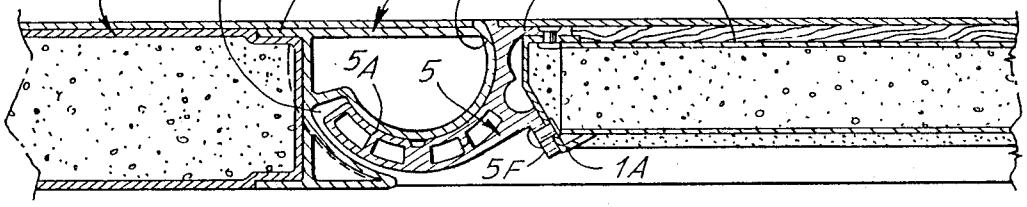

The mobile covering panel 30 is completed at its inclined sides through a section 130 having flanges 130A for the engagement to the same panel 30, and with an appendix 130B (see FIG. 3) which is similar to those indicated by 40B and 64B (see FIG. 4) for cooperating with the appendixes 92E of the upper section of the curtain wall 32 and with its seals 94 and 96. Mobile latches (see FIG. 3) like those indicated by 98, 108 operate in the same way as already described for the other sides of the curtain walls for the blocking. The panel 30 is refined (see FIG. 2B) along the side opposite to the one on which the section 120 is engaged, by means of a section 134 having flanges 134A, for the assembly on the panel 30, and a projection or appendix 134B which receives a seal 136 in the bottom of the channel defined by the same appendix 134B. This beak appendix 134B and the seal 136 are intended to cooperate with the terminal heel 58E of the projection 58C of section 58; the beak profile 134B makes up a drip for the gutter 60 upon the utilization, that is, usage condition shown in FIG. 2.

Figure 34:
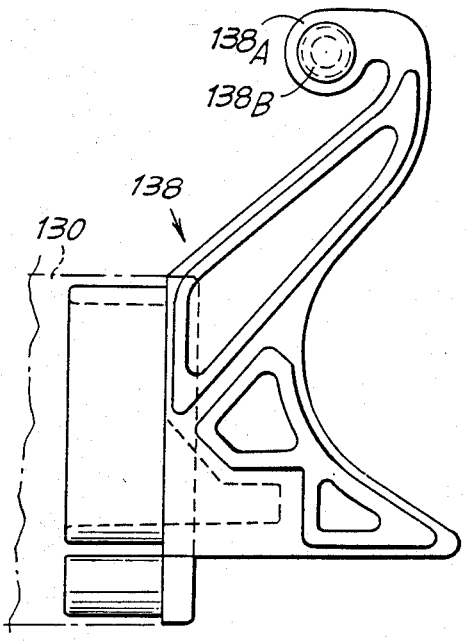
FIGS. 34 to 36 show, in three views, an angle bar providing a hinge for the mobile covering.
Figure 36:
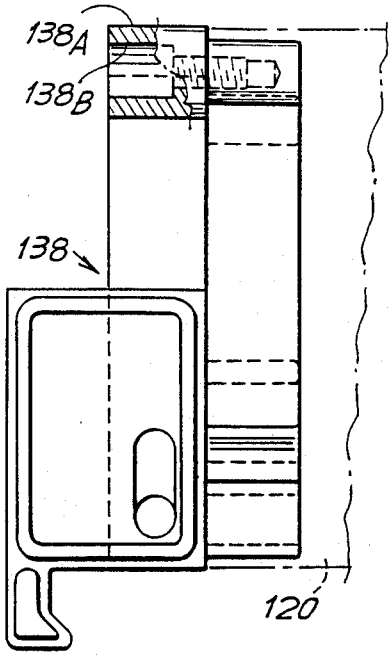
Figure 35:
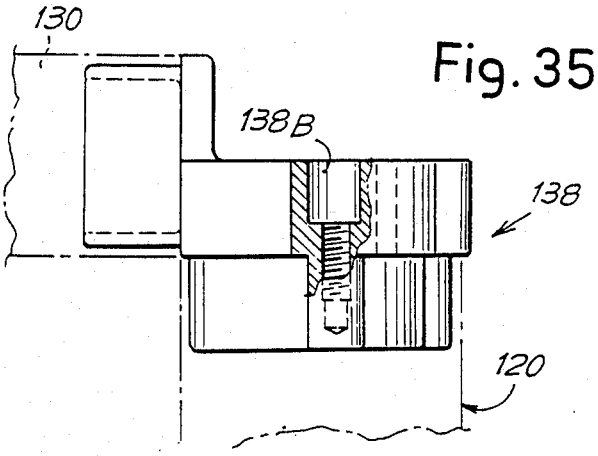

FIGS. 34, 35 and 36 show one of the angle bars 138 which are intended for fitting the sections 130 to the section 120 at the respective angles of the panel 30. In particular, the angle bar 138 has an appendix 138A corresponding to the nucleus 120B of the section 120, which appendix 138A makes up a seat 138B for receiving a pin able to engage the mobile covering panel 30 to the section 18, in order to prevent the nucleus 120B from moving away from the cradle of the section 18.

Figure 38:
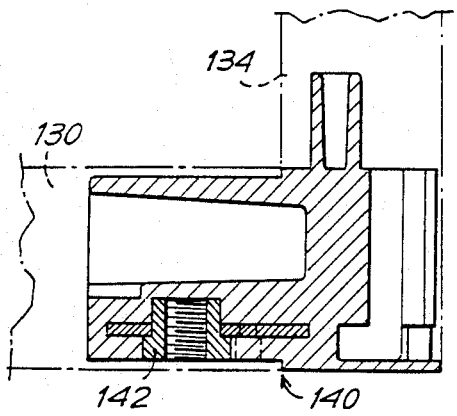
FIGS. 37 to 39 show, in three views, an outer angle bar of the mobile covering.
Figure 37:
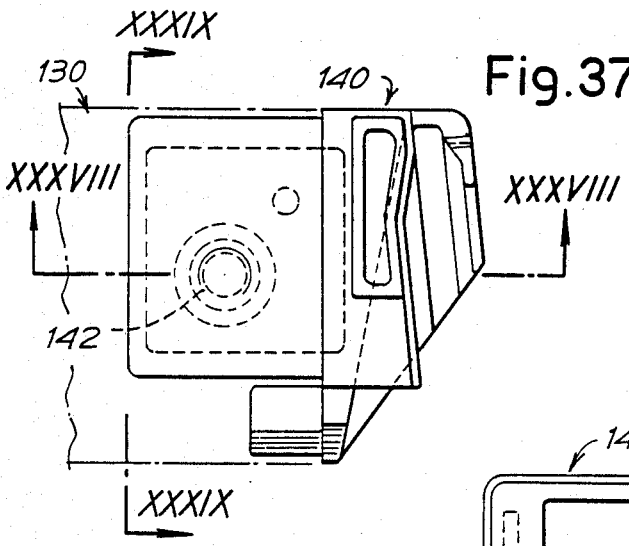
Figure 39:
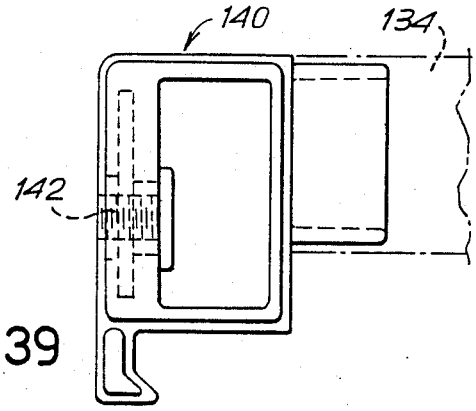
Figure 40:
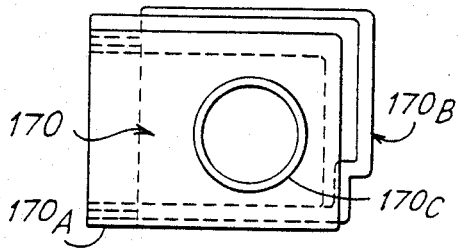
FIGS. 40 to 44 show an angle bar or gutter which is used for conveying water.
Figure 44:
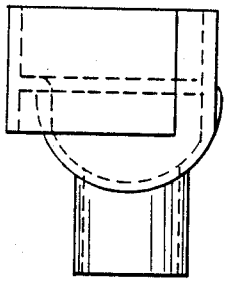
Figure 42:
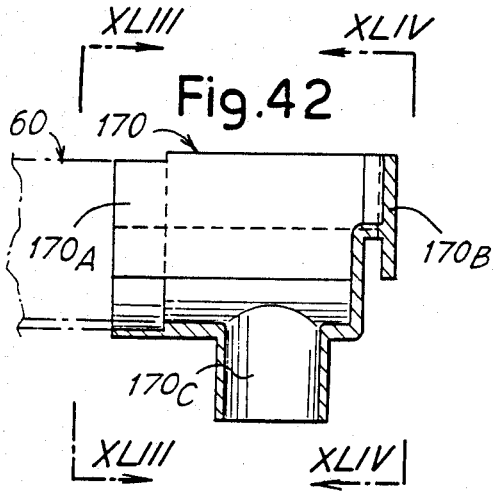
Figure 43:
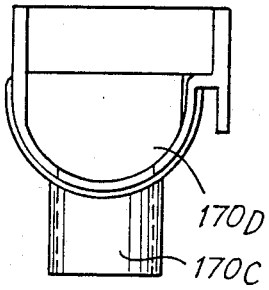
Figure 41:
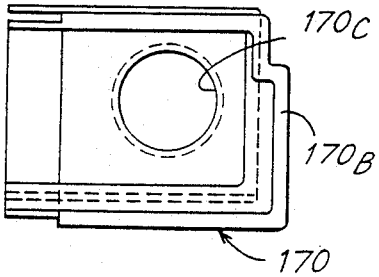

FIGS. 37, 38 and 39 show a further angle bar 140 which connects the two concurrent pulltrudeds 130 and 134 (see FIG. 3) of the mobile covering 30, between them. In particular, this angle bar 140 has a bush 142 embedded therein along the joint for the section 130, said bush having the purpose to allow the insertion of a pin on which the metal rope—provided for the panel positioning from a horizontal to a vertical position—is to be hooked.

When the mobile covering 30 is lifted to the arrangement of FIG. 2, it is caused to press on a seal 144 carried by the end section 14 of the fixed covering part 12, 12A, so as to ensure the sealing. When the mobile covering 30 is made to rest on the vertical longitudinal mobile wall 28, the seal 136 rests on the end heel 58E of the section 58, thereby ensuring the sealing also in collaboration with a further seal 146 carried by the section 134 and acting on the outer surface of the wall 58C of the section 58 (see FIG. 2). In order to reach the use condition, the mobile covering 130 is slightly lifted above the position of its final arrangement so that the mobile longitudinal wall 28 is able—by moving about the articulation defined by the profiles 50A and 54B—to place itself against the seal 146 by passing below the beak appendix 134B. A slight lowering of the same mobile covering 30 is then provided until the seal 136 rests on the heel 58E of the wall 58C of the upper section 58 of the mobile longitudinal wall 28. In this way, there are obtained both the connection between the mobile wall 28 and the mobile covering 30 and the sealing by the two seals 146 and 136, as well as the water drain from the drip formed by the appendix 134B in the gutter 60 that discharges same drain in the fall pipe 66, 66A for the disposal.

The seal 144 performs also a second task when the assembly of the mobile components takes up the folding arrangement shown in FIG. 6 under the condition of minimum overall dimensions. Under these conditions, the mobile platform 26, being lifted around the articulation formed by sections 5 and 34, reaches a position below the terminal section 14 of the fixed covering. Under these conditions (FIG. 6), the surface 50B of the section 50 of said mobile platform 26 comes into contact and presses on the seal 144 which ensures a substantial sealing action against dust and atmospheric agents thereby protecting what is included between the panel of the mobile platform 26 and the side structure 7, 7A of the main framework of the assembly, namely, the components 28, 30, 32 and the inside of the central structure.

The seal 52 ensures the sealing between the section 50 and the extension 54C of section 54 in order to seal the mobile platform 26 and the longitudinal vertical mobile wall 28 between each other.

The seals 96 and 94, provided on the sections 92 on three sides of each of the curtain walls 32, ensures the sealing of the mobile platform 26 with the sections 40. with the section 130 of the covering 30 and with the side vertical sections 64 of the outer longitudinal mobile wall 28.

Figure 4:
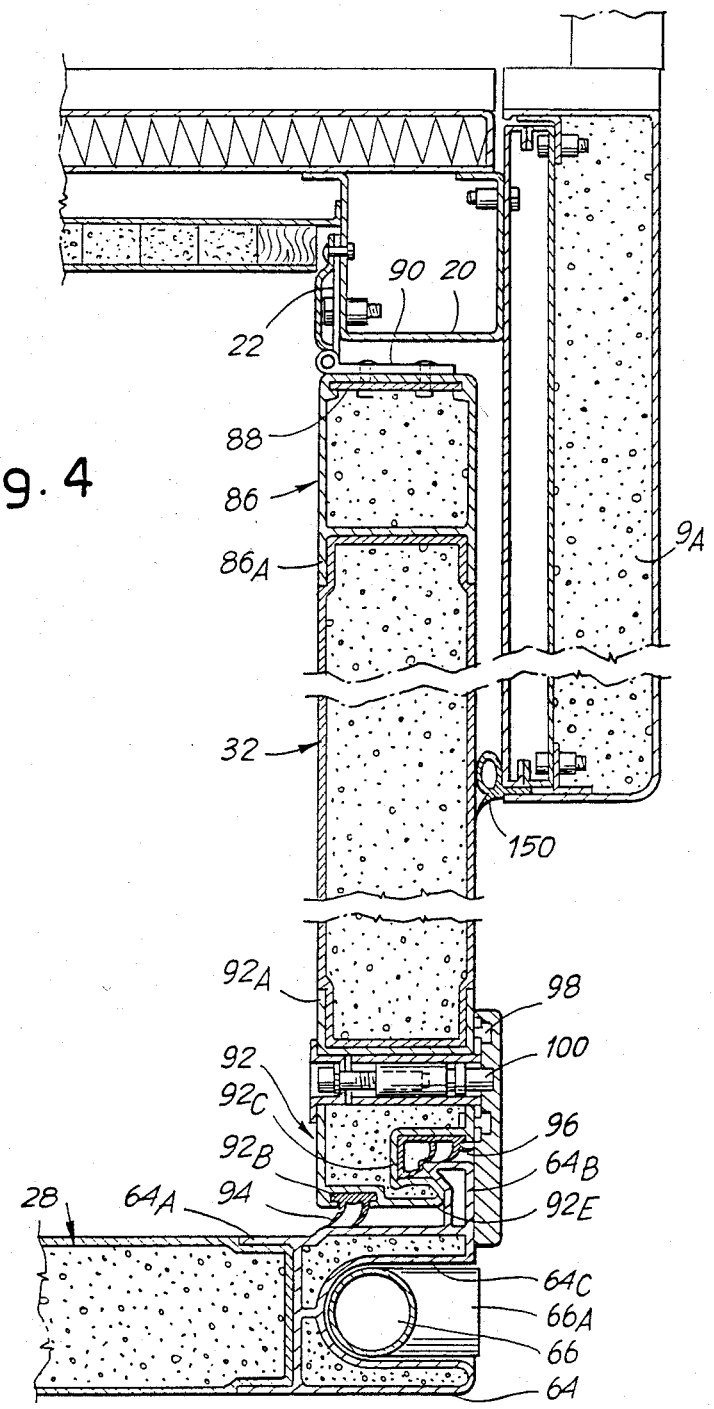
FIG. 4 is a horizontal local sectional view on line IV—IV of FIG. 1, showing the lower part of the curtain wall.
Figure 5:
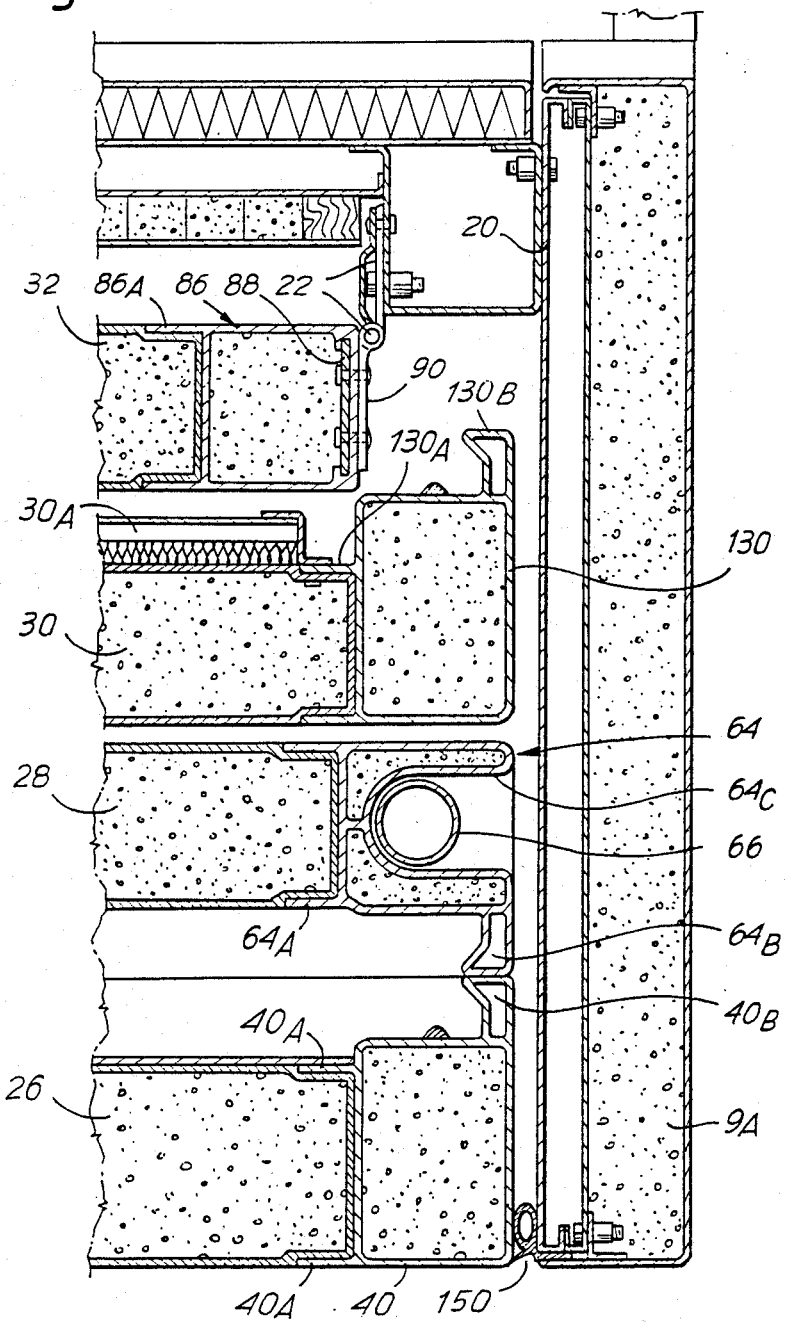
FIG. 5 is similar to FIG. 4, but showing the components in the closed condition.

Along the end corners of the extensions 9A of head walls 9, a vertical seal—that cooperates with the curtain walls 32 in the opening position—is provided, as shown in FIG. 4, said seal cooperating, instead, with the sections 40 of the mobile platform 26 in the closing condition shown in FIG. 5, thus completing the protective action, together with the seal 144, in the closing conditions of the mobile components against the fixed structure.

By the described arrangement of the sections surrounding the various panels, of the seals and of articulations through sliding seats and convex surfaces for the sliding of the mobile panels, many advantages are obtained for rapidity in the industrial assembling and life without alterations, because of the articulations construction, for the possibility of an easy maintenance and for the materials which, at least in part, are utilized for the sections and which are protrusions made up of glass fiber and polyester or other resin, and are actually insensitive to the age alterations and to atmospheric and anyway chemical agents.

The disposition according to inclined planes of the profiles (like those of parts 40B; 92E; 64B; 92E; etc) of some of the described sections, in combination with the clamping system by means of screw latches (like those indicated by 98, 108) permits—after the opening of the assembly of the mobile components—a tightening action of the curtain walls against the edges of the panels concurrent to said walls, thus achieving a mechanical rigid stabilization of all the components and ensuring as well, through their seals, a hermetic outward sealing.

The sections system has been studied to provide also a suitable appearance to the internal surfaces of the rooms delimited by the mobile components peripherically finished by the above described sections.

It is understood that the drawing shows an exemplification given only as a practical demonstration of the invention, as this way vary in the forms and dispositions, without, nevertheless, departing from the scope of the idea on which same invention is based. The possible presence of reference numbers in the attached claims has the purpose of facilitating the reading of the claims, reference being made to the description and drawing, and does not limit the scope of protection pointed out by the claims.

I claim:

1. A transportable structure for making a building having a closed storage condition and an opened use condition, comprising:

a fixed floor (1) having opposite ends and an outer longitudinal edge;

a fixed roof (12) having opposite ends and an outer longitudinal edge;

a pair of head walls (9) connected to said opposite ends of said fixed floor and fixed roof, and defining a volume with said fixed floor and fixed roof;

a curved cradle section (5) connected to and extending along said outer longitudinal edge of said fixed floor;

a mobile floor (26) having an inner longitudinal edge and an outer longitudinal edge and an outer longitudinal edge, said mobile floor having a partly cylindrical protrusion (34) slidably engaged with said cradle section and disposed at and along said inner longitudinal edge of said mobile floor for rotatably mounting and mobile floor to said fixed floor between a vertical storage position in said volume and a horiziontal use position extending out of said volume;

a mobile longitudinal wall (28) rotatably mounted to said mobile floor at said outer longitudinal edge of said mobile floor for movement between a storage position substantially parallel to said mobile floor, and a vertically extending use position, and a mobile roof (30) rotatably mounted to said fixed roof at a location under said fixed roof and inwardly of said outer longitudinal edge of said fixed roof for movement between a vertical storage position in said volume and a use position extending out of said volume, said mobile roof having an inner longitudinal edge rotatably mounted to said fixed roof and an outer longitudinal edge which engages on said longitudinal wall in said use position of said mobile roof and said longitudinal wall, a first pair of angle bars (42) connected to said mobile floor at opposite ends of said inner longitudinal edge thereof, a first pair of terminals (46) connected to said cradle section at opposite ends of said outer longitudinal edge of said fixed floor, one of said first pair of angle bars and said first pair of terminals carrying seats and the other of said first pair of angle bars and first first pair of terminals carrying pins engaged in said seats for securely and slidably engaging said partly cylindrical protrusion (34) against said curved cradle section (5).

2. A transportable structure according to claim 1, wherein said curved cradle section has an upwardly concave partly cylindrical profile and said partly cylindrical protrusion is downwardly convex and slidably engaged in said profile.

3. A transportable structure according to claim 1, including a finishing section (120) fixed to said inner longitudinal edge of said mobile roof, said finishing section extending upwardly with respect to said volume when said mobile roof is in its use position, said finishing section having an edge spaced away from said mobile roof which carries an articulation nucleus (120B) having a partly cylindrical downwardly convex profile, and a second curved cradle section (18) fixed under said fixed roof and positioned inwardly of said outer longitudinal edge of said fixed roof for slidably receiving said articulation nucleus for rotatably connecting said mobile roof to said fixed roof, said mobile roof being positioned inwardly of said mobile floor when said mobile roof and floor are in their storage positions in said volume.

4. A transportable structure according to claim 3, including a skirt section (14) connected to said outer longitudinal edge of said fixed roof and extending downwardly of said fixed roof, a seal connected to a lower end of said skirt section and extending longitudinaly therealong, said mobile roof having an upper surface in its use positition which is sealingly engaged against said seal.

5. A transportable structure according to claim 4, including a fixed longitudinal wall (7) extending vertically and fixed between said head walls (9), a longitudinally extending mobile element (124) hinged to said fixed longitudinal wall for movement from an upwardly extending storage position to a use position extending substantially parallel to said mobile roof in its use position, and a longitudinally extending elastic flashing (122) connected to said mobile roof (30) adjacent said inner longitudinal edge thereof for engagement by said mobile element with said mobile roof and mobile element in their use positions.

6. A transportable structure according to claim 5, including a beak shaped projection (134B) connected to said outer longitudinal edge of said mobile roof (30), and a gutter channel (60) connected to said mobile longitudinal wall (28) at a longitudinal edge thereof which is opposite from said outer longitudinal edge of said mobile floor, said gutter channel including an inner heel (58E) over which said beak shaped projection engages with said mobile roof and said mobile logitudinal wall in their use positions.

7. A transportable structure according to claim 1, wherein said mobile floor has a longitudinally extending section (50) at said outer longitudinal edge thereof having an upper end carrying a semicylindrical saddle (50E), said mobile longitudinal wall (28) having a lower end in its use position carrying a cylindrical convex profile (54) for slidable and rotatable mounting against said semi-cylindrical saddle.

8. A transportable structure according to claim 7, wherein said semicylindrical saddle includes an arcuate stop terminal (50F), said cylindrical convex profile (58) carrying a projection for engaging in said arcuate stop terminal with said mobile longitudinal wall in its storage position.

9. A transportable structure according to claim 7 including a downwardly extending wing (54C) extending downwardly from a lower longitudinal end of said mobile longitudinal wall (28) in said use position thereof, and a seal (52) connected to said external section (50) of said mobile floor (26) and sealingly engaged against said wing in said use position of said mobile longitudinal wall.

10. A transportable structure according to claim 1, wherein said protrusion (34) is made of glass fiber and resin and said curved cradle section is made of metal whereby a sliding seal is defined between said cradle section and said protrustion.

11. A transportable structure according to claim 4, wherein said mobile floor in its vertical storage position engages against said seal (144) connected to said fixed groove (12) for sealing said volume with said mobile floor in its storage position.

12. A transportable structure for making a building having a closed storage condition and an opened use condition comprising;

a fixed floor (1) having ends and an outer longitudinal edge;

a fixed roof (12) having opposite ends and an outer longitudinal edge;

a pair of head walls (9) connected to said opposite ends of said fixed floor and fixed roof, and defining a volume with said fixed floor and fixed roof;

a curved cradle section (5) connected to and extending along said outer longitudinal edge of said fixed floor;

a mobile floor (26) having an inner longitudinal edge and an outer longitudinal edge, said mobile floor having a partly cylindrical protrusion (34) slidably engaged with said cradle section and disposed at and along said inner longitudinal edge of said mobile floor for rotatably mounting said mobile floor to said fixed floor between a vertical storage position in said volume and a horizontal use position extending out of said volume;

a mobile longitudinal wall (28) rotatably mounted to said mobile floor at said outer longitudinal edge of said mobile floor for movement between a storage position substantially parallel to said mobile floor, and a vertically extending use position; and a mobile roof (30) rotatably mounted to said fixed roof at a location under said fixed roof and inwardly of said outer longitudinal edge of said fixed roof for movement between a vertical storage position in said volume and a use position extending out of said volume, said mobile roof having an inner longitudinal edge rotatably mounted to said fixed roof and an outer longitudinal edge which engages on said longitudinal wall in said use position of said mobile roof and said longitudinal wall, said partly cylindrical protrusion (34) of said mobile floor (26) including a curved notch (34B), said curved cradle section (5) extending into said curved notch with said mobile floor in its use position.

* * * * *